US009057122B2

(12) United States Patent
Takaoka et al.

(10) Patent No.: US 9,057,122 B2
(45) Date of Patent: Jun. 16, 2015

(54) HIGH-STRENGTH STEEL PLATE EXCELLENT IN DROP WEIGHT PROPERTIES

(75) Inventors: Hiroyuki Takaoka, Kobe (JP); Eiichi Tamura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 296 days.

(21) Appl. No.: 13/642,994

(22) PCT Filed: Mar. 15, 2011

(86) PCT No.: PCT/JP2011/056097

§ 371 (c)(1),
(2), (4) Date: Oct. 23, 2012

(87) PCT Pub. No.: WO2011/142172

PCT Pub. Date: Nov. 17, 2011

(65) Prior Publication Data

US 2013/0039803 A1 Feb. 14, 2013

(30) Foreign Application Priority Data

May 12, 2010 (JP) ..... 2010-110509

(51) Int. Cl.

| | |
|---|---|
| ***C22C 38/24*** | (2006.01) |
| ***C22C 38/22*** | (2006.01) |
| ***C22C 38/46*** | (2006.01) |
| ***C22C 38/44*** | (2006.01) |
| ***C22C 38/00*** | (2006.01) |
| ***C22C 38/02*** | (2006.01) |
| ***C22C 38/06*** | (2006.01) |
| ***C22C 38/34*** | (2006.01) |
| ***C21D 6/00*** | (2006.01) |
| ***C21D 8/00*** | (2006.01) |
| ***C21D 8/02*** | (2006.01) |

(52) U.S. Cl.

CPC ..... *C22C 38/22* (2013.01); *C22C 38/001* (2013.01); *C22C 38/02* (2013.01); *C22C 38/06* (2013.01); *C22C 38/24* (2013.01); *C22C 38/34* (2013.01); *C21D 6/005* (2013.01); *C21D 8/00* (2013.01); *C21D 8/02* (2013.01); *C21D 2211/002* (2013.01); *C21D 2211/004* (2013.01)

(58) Field of Classification Search

None

See application file for complete search history.

(56) References Cited

FOREIGN PATENT DOCUMENTS

| | | |
|---|---|---|
| CN | 101186960 | 5/2008 |
| CN | 101525721 A | 9/2009 |
| CN | 101665887 A | 3/2010 |

(Continued)

OTHER PUBLICATIONS

Machine-English translation of Japanese patent No. 2003-342672, Fujiwara Tomoya et al., Dec. 3, 2003.*

(Continued)

*Primary Examiner* — Deborah Yee

(74) *Attorney, Agent, or Firm* — Oblon, McClelland, Maier & Neustadt, L.L.P.

(57) ABSTRACT

Disclosed is a high-strength steel plate having a predetermined chemical composition, in which a microstructure of the steel plate at a depth of one-fourth to one half the thickness from a surface has an area fraction of bainite of 90% or more, an average lath width of bainite of 3.5 μm or less, and a maximum equivalent circle diameter of martensite-austenite constituents in bainite of 3.0 μm or less. The steel plate exhibits high strengths and good drop weight properties and is useful as structural materials for offshore structure, ships, and bridges, as well as materials for pressure vessels in nuclear power plants.

20 Claims, 1 Drawing Sheet

(56) References Cited

FOREIGN PATENT DOCUMENTS

| | | |
|---|---|---|
| JP | 55 79828 | 6/1980 |
| JP | 60 155620 | 8/1985 |
| JP | 2 93045 | 4/1990 |
| JP | 2003 342672 | 12/2003 |
| JP | 2008 274405 | 11/2008 |
| JP | 2009 235524 | 10/2009 |
| JP | 2010 100903 | 5/2010 |

OTHER PUBLICATIONS

Table 1.1 entitled "Essential and Incidental Elements in Steel and Cast iron", Introduction to Steels and Cast Irons, ASM 4$^{th}$ Edition, Oct. 2004.*

International Search Report Issued Jun. 14, 2011 in PCT/JP11/56097 Filed Mar. 15, 2011.

* cited by examiner

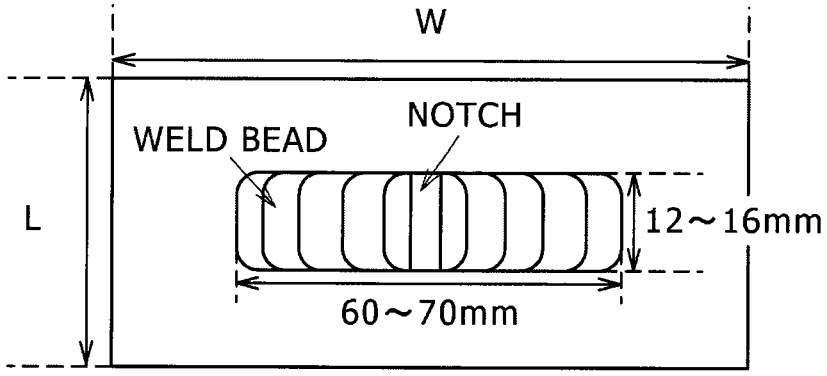
W
NOTCH
WELD BEAD
L
12～16mm
60～70mm

HIGH-STRENGTH STEEL PLATE EXCELLENT IN DROP WEIGHT PROPERTIES

TECHNICAL FIELD

The present invention relates to high-strength steel plates used as structural materials typically for offshore structures, ships, and bridges and as materials for pressure vessels in nuclear power plants. Specifically, the present invention relates to steel plates having high strengths and improved drop weight properties.

BACKGROUND ART

Quenched and tempered steel plates (hereinafter also referred to as "QT steel plates") have high strengths and good toughness, have satisfactory weldability, and have therefore been widely used in welded structures such as bridges, high-rise buildings, ships, and tanks. With increasing sizes of welded structures in recent designing, the QT steel plates are required to have higher strengths (for example, a yield strength of 415 MPa or more and a tensile strength of 620 MPa or more).

Steel plates should not only have high strengths but also exhibit good drop weight properties which are indices of brittle fracture properties. However, with increasing strengths and thicknesses required of steel plates in present circumstances, it is difficult for the steel plates to have good drop weight properties.

Patent Literature (PTL) 1 discloses a technique as a possible solution to improve drop weight properties. According to this technique, a phosphorus content is minimized to induce grain boundary strengthening (crystal stressing), nitrogen is added in a predetermined amount to induce grain refining effects, and chromium is added to improve toughness. A steel sheet obtained according to the technique, however, has a nil-ductility transition temperature (NDT) of at most about −50° C. and does not meet the recently required properties. The nil-ductility transition temperature is an index of drop weight properties.

PTL 2 proposes a technique of performing low-temperature rolling to form fine ferrite grains to thereby provide good drop weight properties. This technique, however, fails to give high strengths and therefore fails to provide both good drop weight properties and high strengths compatibly.

PTL 3 proposes a technique of performing quenching with a roller quench system to form fine ferrite grains while suppressing the formation of bainite, so as to provide good drop weight properties. Even this technique, however, fails to give high strengths and fails to provide both good drop weight properties and high strengths compatibly.

CITATION LIST

Patent Literature

PTL 1: Japanese Unexamined Patent Application Publication (JP-A) No. H02-93045
PTL 2: JP-A No. S55-79828
PTL 3: JP-A No. S60-155620

SUMMARY OF INVENTION

Technical Problem

The present invention has been made under these circumstances, and an object thereof is to provide a high-strength steel plate which can exhibit both high strengths and good drop weight properties and is useful typically as structural materials for offshore structures, ships, and bridges and as materials for pressure vessels in nuclear power plants.

Solution to Problem

The present invention has achieved the object and provides a high-strength steel plate, containing C in a content of 0.03% to 0.150%; Si in a content of 0% or more and 0.5% or less; Mn in a content of 1.0% to 2.0%; P in a content of more than 0% and less than or equal to 0.015%; S in a content of more than 0% and less than or equal to 0.01%; Al in a content of 0.005% to 0.06%; Cr in a content of 0.10% or more and 0.5% or less; Mo in a content of 0.05% to 0.5%; V in a content of more than 0% and less than or equal to 0.10%; N in a content of 0.0020% to 0.010%; and O in a content of more than 0% and less than or equal to 0.010%, in mass percent, with the remainder including iron and inevitable impurities. A microstructure of the steel plate at a depth of one-fourth to one half the thickness from a surface of the steel plate has an area fraction of bainite of 90% or more, an average lath width of bainite of 3.5 μm or less, and a maximum equivalent circle diameter of martensite-austenite constituents in bainite of 3.0 μm or less.

The martensite-austenite constituents in the steel plate according to the present invention preferably have an average equivalent circle diameter of 1.0 μm or less. This helps the steel plate to have better drop weight properties. As used herein the term "equivalent circle diameter" is an index of the size of a martensite-austenite constituent (hereinafter also simply referred to as "MA") and refers to a diameter of a corresponding circle having an area equal to that of the martensite-austenite constituent.

Where necessary, the steel plate according to the present invention may effectively further contain one or more of (a) Cu in a content of more than 0% and less than or equal to 2% and/or Ni in a content of more than 0% and less than or equal to 2%; (b) Nb in a content of more than 0% and less than or equal to 0.05% and/or B in a content of more than 0% and less than or equal to 0.005%; (c) Mg in a content of more than 0% and less than or equal to 0.005% and/or Ti in a content of more than 0% and less than or equal to 0.030%; (d) Zr in a content of more than 0% and less than or equal to 0.1% and/or Hf in a content of more than 0% and less than or equal to 0.05%; (e) Ca in a content of more than 0% and less than or equal to 0.0035%; (f) Co in a content of more than 0% and less than or equal to 2.5% and/or Win a content of more than 0% and less than or equal to 2.5%; and (g) at least one rare-earth element in a total content of more than 0% and less than or equal to 0.01%. The steel plate, when containing any of these elements, can have further satisfactory properties according to the type of the element contained.

When the steel plate further contains Ti, the Ti content is preferably 0.005% to 0.030%, and titanium-containing dispersed particles present in the steel plate preferably have an average equivalent circle diameter of 40 nm or less and preferably have a minimum equivalent circle diameter of 10 nm or more. The steel plate, when satisfying these conditions, may have further better toughness of a heat-affected zone (HAZ) in addition to good drop weight properties. As used herein the term "titanium-containing dispersed particles" refers to dispersed particles of carbides, nitrides, and oxides, as well as carbonitrides and other complex compounds of them, each containing titanium.

Advantageous Effects of Invention

The present invention can provide a steel plate exhibiting both high strengths and good drop weight properties by suitably controlling a chemical composition and strictly specifying a microstructure. The steel plate is extremely useful as structural materials typically for offshore structure, ships, and bridges, and as materials for pressure vessels in nuclear power plants.

BRIEF DESCRIPTION OF DRAWINGS

FIG. 1 is a plan view illustrating dimensions of a specimen used in a drop weight test.

DESCRIPTION OF EMBODIMENTS

The present inventors made investigations from various angles about techniques for providing a steel plate surely having both high strengths and good drop weight properties. As a result, they have found that a steel plate has high strengths by having a microstructure mainly including bainite (with an area fraction of bainite of 90% or more); and that the steel plate effectively has better drop weight properties by having an average of widths of bainite laths (widths of bainite in the form of bundles) of 3.5 μm or less and having a size (in terms of maximum of equivalent circle diameters) of MA in bainite of 3.0 μm or less. The present invention has been made based on these findings.

The microstructure in the steel plate according to the present invention is evaluated at a position of a depth of one-fourth to one half the thickness of the steel plate. This position is selected as a representative position for the evaluation of properties of such steel plates.

The regulation of the lath width of bainite is important in the steel plate according to the present invention. The lath width affects drop weight properties, and the steel plate, when having an average of the lath widths (average lath width) of 3.5 μm or less, can have good drop weight properties. This is probably because laths, when present with such a relatively narrow width, increase in number and thereby more effectively inhibit fracture from proceeding. The lath width of bainite is preferably 3 μm or less, and more preferably 2 μm or less.

Martensite-austenite constituents (MA) are present in the form of sheets or granules between bainite laths in bainite. A maximum of equivalent circle diameters of the martensite-austenite constituents (MA) affects the drop weight properties. The martensite-austenite constituents, when having a maximum of equivalent circle diameters (maximum equivalent circle diameter) of 3.0 μm or less, may significantly contribute to better drop weight properties. This is probably because such relatively fine martensite-austenite constituents hardly cause fracture. The martensite-austenite constituents preferably have an average size (average equivalent circle diameter) of 1.0 μm or less. The steel plate, when satisfying such conditions, has higher energy against fracture and can have better drop weight properties.

The microstructure of the steel plate according to the present invention mainly includes bainite with an area fraction of bainite of 90% or more, and preferably 95% or more. Specifically the microstructure may include bainite alone (with a total area percentage of bainite of 100%) but may also further include one or more other structures partially (i.e., with an area fraction of 10% or less). Exemplary other structures include ferrite, Widmanstatten ferrite, pearlite, martensite, and cementite.

The size (average equivalent circle diameter) of martensite-austenite constituents has a correlation with a value A expressed by following Expression (1) relating to the contents of C, Si, and Al. This finding has been experimentally obtained in relation with the amounts of alloy elements and the size of martensite-austenite constituents. The steel plate, when having a value A of less than 1.0(%), can have a size (average equivalent circle diameter) of martensite-austenite constituents controlled to 1.0 μm or less. Following Expression (1) includes a term (3.3[Si]) relating to Si which is added according to necessity. When Si is not contained, the value A may be calculated according to Expression (1), except for the term; whereas, when Si is contained, the value A may be calculated according to Expression (1) as intact:

$$\text{Value A}=0.34+2.2\times[C]+3.3[Si]+6.1\times[Al] \quad (1)$$

wherein [C], [Si], and [Al] are the contents (in mass percent) of C, Si, and Al, respectively.

Next, a basic chemical composition of the steel plate according to the present invention will be described. The steel plate according to the present invention contains basic elements (C, Si, Mn, P, S, Al, Cr, Mo, V, N, and O) as a steel plate within the following suitable ranges. Reasons why the ranges of the contents of compositions are determined are as follows.

[C in a Content of 0.03% to 0.150%]

Carbon (C) element is necessary for helping the steel plate to have satisfactory strengths. Carbon should be contained in a content of 0.03% or more to exhibit strengths at desired level. However, carbon, if contained in excess, may contrarily adversely affect the drop weight properties. To avoid this, the upper limit of the carbon content is controlled to 0.150%. The carbon content is preferably 0.05% in lower limit and 0.13% in upper limit.

[Si in a Content of 0% or More and 0.5% or Less]

Silicon (Si) element effectively helps the steel plate to have satisfactory strengths and is contained according to necessity. However, Si, if contained in excess, may cause the steel (base metal) to suffer from coarse martensite-austenite constituents (MA) and to suffer from insufficient drop weight properties. To avoid these, the upper limit of the Si content is controlled to 0.5%. The Si content is preferably 0.05% in lower limit and 0.25% in upper limit.

[Mn in a Content of 1.0% to 2.0%]

Manganese (Mn) element effectively helps the steel plate to exhibit better hardenability and to have satisfactory strengths. To exhibit these effects, Mn is contained in a content of 1.0% or more. However, Mn, if contained in excess, may cause the steel plate to have insufficient drop weight properties. To avoid this, the upper limit of the Mn content is controlled to 2.0%. The Mn content is preferably 1.2% in lower limit and 1.6% in upper limit.

[P in a Content of More than 0% and Less than or Equal to 0.015%]

Phosphorus (P) element is an impurity inevitably contaminated into steel, adversely affects the drop weight properties of the steel plate, and is preferably minimized. The phosphorus content is desirably controlled to 0.015% or less from these viewpoints. The phosphorus content is preferably 0.010% in upper limit.

[Sulfur (S) in a Content of More than 0% and Less than or Equal to 0.01%]

Sulfur (S) element is an impurity which combines with alloy elements in the steel plate to form various inclusions and thereby adversely affects the drop weight properties of the steel plate. To avoid these, the sulfur content is preferably minimized and is desirably controlled to 0.01% or less (preferably 0.005% or less) in consideration of degree of cleanliness of practical steels. However, sulfur is inevitably contained in steel as an impurity, and it is difficult to reduce the sulfur content to 0% in industrial production

[Al in a Content of 0.005% to 0.06%]

Aluminum (Al) element effectively serves as a deoxidizer and advantageously helps the steel plate to have a finer microstructure to thereby have higher strengths. To exhibit these effects, the Al content should be 0.005% or more. However, Al, if contained in excess, may cause martensite-austenite constituents (MA) to have larger sizes to cause deterioration in drop weight properties. To avoid these, the upper limit of the Al content is controlled to 0.06%. The Al content is preferably 0.01% in lower limit and 0.04% in upper limit.

[Cr in a Content of 0.10% or More and 0.5% or Less]

Chromium (Cr) element effectively helps the steel plate to have better hardenability to thereby have higher strengths. To exhibit these effects, the Cr content should be 0.10% or more. However, Cr, if contained in excess, may adversely affect the drop weight properties. To avoid this, the Cr content is controlled to 0.5% or less. The Cr content is preferably 0.2% in lower limit and 0.4% in upper limit.

[Mo in a Content of 0.05% to 0.5%]

Molybdenum (Mo) element effectively forms fine carbides and helps the steel plate to have higher strengths. To exhibit these effects, the Mo content should be 0.05% or more. However, Mo, if contained in excess, may promote carbides to be coarse and adversely affect the drop weight properties contrarily. To avoid these, the Mo content is controlled to 0.5% or less. The Mo content is preferably 0.15% in lower limit and 0.3% in upper limit.

[V in a Content of More than 0% and Less than or Equal to 0.10%]

Vanadium (V) element effectively helps the steel plate to have better hardenability to thereby have higher strengths. Vanadium also effectively helps the steel plate to have better resistance to temper softening. However, vanadium, if contained in excess, may adversely affect the drop weight properties. To avoid these, the vanadium content is preferably 0.10% or less, and more preferably 0.05% or less. To exhibit the advantageous effects, the vanadium content is preferably 0.02% or more.

[N in a Content of 0.0020% to 0.010%]

Nitrogen (N) element effectively combines typically with aluminum to form nitrides and thereby helps the steel plate to include a finer structure and to have better drop weight properties. To exhibit these effects, nitrogen should be contained in a content of 0.0020% or more. However, nitrogen, if contained in excess, may adversely affect the drop weight properties contrarily. To avoid this, the nitrogen content is controlled to 0.010% or less. The nitrogen content is preferably 0.004% in lower limit and 0.008% in upper limit.

[O in a Content of More than 0% and Less than or Equal to 0.010%]

Oxygen (O) element is contained as an inevitable impurity and is present as oxides in the steel. However, oxygen, if present in a content of more than 0.010%, may form coarse oxides to adversely affect the drop weight properties. To avoid these, the oxygen content is controlled to 0.010% in upper limit. The oxygen content is preferably 0.003% in upper limit.

The steel plate according to the present invention contains constitutive elements as specified above, with the remainder including iron and inevitable impurities. Specifically, the steel plate may further contain, as the inevitable impurities, elements which are brought into the steel typically from raw materials, construction materials, and manufacturing facilities. The steel plate according to the present invention may further contain one or more of (a) Cu in a content of more than 0% and less than or equal to 2% and/or Ni in a content of more than 0% and less than or equal to 2%; (b) Nb in a content of more than 0% and less than or equal to 0.05% and/or B in a content of more than 0% and less than or equal to 0.005%; (c) Mg in a content of more than 0% and less than or equal to 0.005% and/or Ti in a content of more than 0% and less than or equal to 0.030%; (d) Zr in a content of more than 0% and less than or equal to 0.1% and/or Hf in a content of more than 0% and less than or equal to 0.05%; (e) Ca in a content of more than 0% and less than or equal to 0.0035%; (f) Co in a content of more than 0% and less than or equal to 2.5% and/or W in a content of more than 0% and less than or equal to 2.5%; and (g) at least one rare-earth element in a content of more than 0% and less than or equal to 0.01%. The steel plate, when containing any of these elements, can have further satisfactory properties according to the type of the element contained.

[Cu in a Content of More than 0% and Less than or Equal to 2%; and/or Ni in a Content of More than 0% and Less than or Equal to 2%]

Copper (Cu) and nickel (Ni) elements effectively help the steel plate to have better hardenability and to have higher strengths and are contained according to necessity. However, these elements, if contained in excess, may adversely affect the drop weight properties contrarily. To avoid this, the Cu content and Ni content are each preferably 2% or less, and more preferably 1% or less. To exhibit the aforementioned advantageous effects, the Cu content and Ni content are each preferably 0.2% or more, and more preferably 0.3% or more in lower limit.

[Nb in a Content of More than 0% and Less than or Equal to 0.05% and/or B in a Content of More than 0% and Less than or Equal to 0.005%]

Niobium (Nb) and boron (B) elements effectively help the steel plate to have better hardenability and to have higher strengths. However, these elements, if contained in excess, may form large amounts of carbides and nitrides to adversely affect the drop weight properties. To avoid these, the contents of niobium and boron are preferably controlled to 0.05% or less and 0.005% or less, respectively. The contents of niobium and boron are more preferably 0.04% or less and 0.002% or less, respectively. To exhibit the aforementioned effects advantageously, the niobium content is preferably 0.01% or more, and the boron content is preferably 0.0005% or more.

[Mg in a Content of More than 0% and Less than or Equal to 0.005% and/or Ti in a Content of More than 0% and Less than or Equal to 0.030%]

Magnesium (Mg) and titanium (Ti) elements form oxides and nitrides, prevent austenite grains from being coarse, thereby effectively help the steel plate to have better properties in the heat-affected zone (HAZ), and are contained according to necessity. However, these elements, if contained in excess, may cause the inclusions to be coarse to adversely affect the drop weight properties. To avoid these, the Mg content is preferably 0.005% or less, and more preferably 0.003% or less; and the Ti content is preferably 0.030% or less, and more preferably 0.02% or less.

When the steel plate contains titanium, it is preferred that the Ti content is controlled to 0.005% to 0.030%, and titanium-containing dispersed particles present in the steel plate are controlled to have an average size (average equivalent circle diameter) of 40 nm or less. This helps the steel plate to have further better toughness in the heat-affected zone, in addition to good drop weight properties. The titanium-containing dispersed particles more preferably have an average size of 30 nm or less. The smaller the average size is, the better the properties are.

The titanium-containing dispersed particles are preferably controlled to have a minimum size (minimum equivalent circle diameter) of 10 nm or more. This helps the steel plate to have significantly better HAZ toughness. The titanium-containing dispersed particles more preferably have a minimum size of 15 nm or more.

[Zr in a Content of More than 0% and Less than or Equal to 0.1%; and/or Hf in a Content of More than 0% and Less than or Equal to 0.05%]

Zirconium (Zr) and hafnium (Hf) elements form nitrides with nitrogen, allow austenite grains to be finer, and thereby effectively improve HAZ properties. However, these elements, if contained in excess, may adversely affect the drop weight properties contrarily. To avoid this, the content of Zr, if contained, is preferably 0.1% or less, and more preferably 0.003% or less, and the content of Hf, if contained, is preferably 0.05% or less, and more preferably 0.01% or less.

[Ca in a Content of More than 0% and Less than or Equal to 0.0035%]

Calcium (Ca) element controls shapes of sulfides and thereby contributes to better HAZ properties. However, Ca, if contained in excess of more than 0.0035%, may adversely affect the drop weight properties contrarily. The Ca content is more preferably 0.0020% or less in upper limit.

[Co in a Content of More than 0% and Less than or Equal to 2.5% and/or W in a Content of More than 0% and Less than or Equal to 2.5%]

Cobalt (Co) and tungsten (W) elements help the steel plate to have better hardenability to thereby have higher strengths and are contained according to necessity. However, these elements, if contained in excess, may adversely affect HAZ toughness. To avoid this, the contents of these elements are each preferably 2.5% or less in upper limit. The contents of these elements are each more preferably 0.5% or less in upper limit.

[At Least One Rare-Earth Element (REM) in a Content of More than 0% and Less than or Equal to 0.01%]

Rare-earth elements (REMs) help inclusions (such as oxides and sulfides) to have finer sizes and more spherical shapes, thereby contribute to better toughness of the base metal and of the heat-affected zone, and are contained according to necessity. The inclusions herein are contaminated into the steel inevitably. These elements exhibit the effects more satisfactorily with increasing contents thereof. However, rare-earth elements, if contained in excess, may cause the inclusions to be coarse and thereby adversely affect the drop weight properties. To avoid these, the content (total content) of REMs is preferably controlled to 0.01% or less. As used herein the term "rare-earth element" (REM) means and includes any of lanthanoid elements (fifteen elements from lanthanum (La) to lutetium (Lu)), as well as scandium (Sc) and yttrium (Y).

The steel plate according to the present invention may be manufactured by the following method. A steel having a chemical composition satisfying the above-specified conditions is prepared by melting according to a common ingot making process to give a molten steel, the molten steel is cooled to give a slab, the slab is heated to a temperature in the range typically of 900° C. to 1300° C., subjected to hot rolling, subsequently subjected to rough rolling so as to give a rolling reduction of 10% or more at temperatures in the range of 950° C. to 850° C., subjected to finish rolling so as to give a rolling reduction of 3% to 10% in a final rolling pass at a temperature in the range of 800° C. to 850° C., directly cooled to 400° C. at an average cooling rate of 0.1° C. to 30° C. per second, further reheated to a temperature in the range of 900° C. to 1000° C., quenched, and tempered two or more times at a temperature in the range of 550° C. to 700° C. The ranges of respective conditions in this method are specified for the following reasons. The aforementioned temperatures to be controlled are indicated as temperatures at the surface of the steel plate.

[Heating Temperature of Slab: 900° C. to 1300° C.]

The slab may be heated to 900° C. or higher so as to allow the entire structure of the steel plate to be austenite temporarily. However, heating, if performed to a temperature of higher than 1300° C., may cause austenite grains to be coarse, and this may prevent the steel plate from having a desired structure as a result of subsequent steps.

[Rough Rolling so as to Give a Rolling Reduction of 10% or More at Temperatures in the Range of 950° C. to 850° C.]

The rolling reduction (draft) in this temperature range affects the lath width of bainite. Rough rolling, when performed to a rolling reduction of 10% or more, may allow the average lath width of bainite to be 3.5 μm or less. This effect is obtained in combination with subsequent steps. Rough rolling, if performed to a rolling reduction of less than 10%, may fail to allow the steel plate to have an average lath width of bainite of 3.5 μm or less.

[Finish Rolling so as to Give a Rolling Reduction of 3% to 10% in a Final Rolling Pass at a Temperature in the Range of 800° C. to 850° C.]

The rolling reduction in this temperature range affects the lath width of bainite and the sizes of martensite-austenite constituents. Finish rolling, if performed at a temperature of higher than 850° C. or if performed to a rolling reduction of less than 3%, may cause the steel plate to have a lath width of bainite and/or a size (maximum) of the martensite-austenite constituents of more than the specified value. Rolling in this temperature range to a rolling reduction of more than 10% is not generally performed in finish rolling.

[Direct Cooling Down to 400° C. at an Average Cooling Rate of 0.1° C. to 30° C. Per Second]

After finish rolling, the steel plate may be directly cooled down to 400° C. at an average cooling rate of 0.1° C. to 30° C. per second. Cooling, if performed at an average cooling rate of less than 0.1° C. per second or more than 30° C. per second, may fail to help the steel plate to have a structure mainly containing bainite. The cooling process is performed down to 400° C. because no structural transformation further occurs at temperatures below this temperature. The direct cooling is performed because this allows the structure before quenching to be fine and thereby gives a fine structure after quenching.

[Reheating Temperature Upon Quenching 900° C. to 1000° C.]

Reheating may be performed to a temperature of 900° C. or higher so as to obtain an austenitic structure. However, reheating, if performed to a temperature of higher than 1000° C., may cause coarse austenite grains. The steel plate may be reheated to a temperature in the specific range and then cooled for quenching at an average cooling rate of 0.5° C. to 20° C. per second, so as to exhibit quenching effects and to give a desired structure (structure mainly containing bainite). Specifically, cooling upon quenching, if performed at an average cooling rate of less than 0.5° C. per second, may give not a structure mainly containing bainite but a structure mainly containing ferrite and pearlite. Cooling, if performed at an average cooling rate of more than 20° C. per second, may give a structure mainly containing martensite.

[Two or More Tempering Processes at a Temperature in the Range of 550° C. to 700° C.]

Tempering is performed after the quenching. It is also important to control the tempering conditions. The tempering conditions affect the lath width of bainite and the size (maximum equivalent circle diameter) of the martensite-austenite constituents. Tempering, if performed at a temperature of lower than 550° C. or if performed only once, may cause the steel plate to have a size (maximum equivalent circle diameter) of the martensite-austenite constituents of more than the specified value. Tempering, if performed at a temperature of higher than 700° C., may cause the steel plate to have a lath width of bainite of more than the specified value.

When Ti is contained in a content of 0.005% to 0.030% and the sizes of titanium-containing dispersed particles present in the steel plate are controlled, the steel plate according to the present invention may be manufactured by the aforementioned method, except for further controlling conditions in the following manner.

Initially, the slab is heated to a temperature of 1150° C. or higher. Heating of the slab to such a relatively high temperature may allow titanium-containing dispersed particles already present at the time of heating to melt and to have a small average size. In addition, heating to a relatively high temperature may promote the growth of titanium-containing dispersed particles formed during subsequent steps, and this may reduce the amount of fine titanium-containing dispersed particles finally remained. Heating is preferably performed to a temperature of 1200° C. or higher. Heating, when performed to a temperature of 1200° C. or higher, may allow the titanium-containing dispersed particles to have a minimum size of 10 nm or more.

The sizes of titanium-containing dispersed particles are known to be affected by the contents of elements such as C, Si, Mn, Nb, Cu, Ni, Cr, Mo, and V. The present inventors made investigations and have experimentally found that control of the titanium-containing dispersed particles to have an average size of 40 nm or less requires control of contents of added elements so as to give a value X expressed by following Expression (2) of 40(%) or more, in addition to the control of the slab heating temperature. The value X is preferably 45(%) or more, and more preferably 50(%) or more. However, the value X is preferably 150(%) or less, and more preferably 100(%) or less, for avoiding deterioration in toughness.

Expression (2) include terms relating to elements contained according to necessity, such as Si, Nb, Cu, and Ni. When any of these elements is not contained, the value X may be calculated according to Expression (2), except for the term relating to the element not contained; whereas, when all these elements are contained, the value X may be calculated according to following Expression (2):

$$X=500\times[C]+32\times[Si]+8\times[Mn]-9\times[Nb]+14\times[Cu]+17\times[Ni]-5\times[Cr]-25\times[Mo]-34\times[V] \quad (2)$$

wherein [C], [Si], [Mn], [Nb], [Cu], [Ni], [Cr], [Mo], and [V] are contents (m mass percent) of C, Si, Mn, Nb, Cu, Ni, Cr, Mo, and V, respectively.

The present invention may be basically applied to steel plates having a thickness of 50 mm or more, but can be applied to steel plates having a thickness out of this range and, even in this case, can exhibit equivalent advantageous effects.

EXAMPLES

The present invention will be illustrated in further detail with reference to several experimental examples below. It should be noted, however, that the examples are never construed to limit the scope of the invention; various modifications and changes are possible without departing from the scope and sprit of the invention; and all of them fall within the true spirit and scope of the invention.

Experimental Example 1

Steels having chemical compositions given in following Tables 1 and 2 were prepared as molten steels according to a common ingot making process (melting process), the molten steels were cooled into slabs (thickness: 300 mm), sequentially subjected to hot rolling, cooling, and tempering under conditions given in following Tables 3 and 4, and yielded steel plates (thickness: 100 mm). REM as indicated in Tables 1 and 2 was added in the form of a misch metal containing about 50% of Ce and about 25% of La. The symbol "-" in an element in Tables 1 and 2 indicates that the element was not added.

TABLE 1

| Test | Chemical composition* (in mass percent) | | | | | | | | | | | | |
|---|---|---|---|---|---|---|---|---|---|---|---|---|---|
| Number | C | Si | Mn | P | S | Al | Cu | Ni | Cr | Mo | V | Nb | Ti |
| 1 | 0.130 | 0.25 | 1.30 | 0.007 | 0.003 | 0.030 | 0.20 | 0.45 | 0.15 | 0.25 | 0.035 | 0.040 | — |
| 2 | 0.130 | 0.25 | 1.50 | 0.007 | 0.003 | 0.030 | 0.06 | 0.40 | 0.25 | 0.27 | 0.020 | — | — |
| 3 | 0.130 | 0.25 | 1.50 | 0.007 | 0.003 | 0.030 | 0.06 | 0.40 | 0.25 | 0.27 | 0.020 | — | — |
| 4 | 0.080 | 0.05 | 1.50 | 0.010 | 0.002 | 0.030 | — | — | 0.25 | 0.25 | 0.040 | — | — |
| 5 | 0.080 | 0.05 | 1.50 | 0.010 | 0.002 | 0.030 | — | — | 0.25 | 0.25 | 0.045 | — | — |
| 6 | 0.080 | 0.05 | 1.50 | 0.010 | 0.002 | 0.030 | — | — | 0.25 | 0.25 | 0.050 | — | — |
| 7 | 0.080 | 0.05 | 1.50 | 0.010 | 0.002 | 0.030 | — | — | 0.25 | 0.25 | 0.055 | — | — |
| 8 | 0.080 | 0.05 | 1.50 | 0.010 | 0.002 | 0.030 | — | — | 0.25 | 0.25 | 0.055 | — | — |
| 9 | 0.080 | 0.05 | 1.50 | 0.010 | 0.002 | 0.030 | — | — | 0.25 | 0.25 | 0.060 | — | — |
| 10 | 0.080 | 0.05 | 1.50 | 0.010 | 0.002 | 0.030 | — | — | 0.25 | 0.25 | 0.060 | — | — |
| 11 | 0.080 | 0.05 | 1.50 | 0.010 | 0.002 | 0.035 | 0.20 | — | 0.25 | 0.25 | 0.050 | — | — |
| 12 | 0.080 | 0.05 | 1.50 | 0.010 | 0.002 | 0.030 | — | 0.20 | 0.25 | 0.25 | 0.050 | — | — |
| 13 | 0.080 | 0.05 | 1.50 | 0.010 | 0.002 | 0.035 | 0.20 | 0.20 | 0.25 | 0.25 | 0.050 | — | — |
| 14 | 0.080 | 0.05 | 1.50 | 0.010 | 0.002 | 0.030 | — | — | 0.50 | 0.25 | 0.050 | — | — |
| 15 | 0.080 | 0.05 | 1.50 | 0.010 | 0.002 | 0.030 | — | — | 0.25 | 0.45 | 0.050 | — | — |
| 16 | 0.080 | 0.05 | 1.50 | 0.010 | 0.002 | 0.030 | — | — | 0.25 | 0.25 | 0.065 | — | — |
| 17 | 0.080 | 0.05 | 1.50 | 0.010 | 0.002 | 0.035 | — | 0.45 | 0.25 | 0.25 | 0.020 | 0.010 | — |
| 18 | 0.080 | 0.05 | 1.50 | 0.010 | 0.002 | 0.030 | — | — | 0.25 | 0.25 | 0.050 | — | — |
| 19 | 0.080 | 0.05 | 1.50 | 0.010 | 0.002 | 0.030 | — | — | 0.25 | 0.25 | 0.050 | — | — |
| 20 | 0.080 | 0.05 | 1.50 | 0.010 | 0.002 | 0.030 | — | — | 0.25 | 0.25 | 0.050 | — | — |
| 21 | 0.080 | 0.05 | 1.50 | 0.010 | 0.002 | 0.030 | — | — | 0.25 | 0.25 | 0.050 | — | — |
| 22 | 0.080 | 0.05 | 1.50 | 0.010 | 0.002 | 0.030 | — | — | 0.25 | 0.25 | 0.050 | — | — |
| 23 | 0.080 | 0.05 | 1.50 | 0.010 | 0.002 | 0.030 | — | — | 0.25 | 0.25 | 0.050 | — | — |
| 24 | 0.073 | 0.05 | 1.50 | 0.010 | 0.002 | 0.035 | — | — | 0.25 | 0.35 | 0.050 | — | 0.012 |

| Test | Chemical composition* (in mass percent) | | | | | | | | | | Value A |
|---|---|---|---|---|---|---|---|---|---|---|---|
| Number | B | N | Ca | O | Mg | Zr | Hf | W | Co | REM | (%) |
| 1 | — | 0.0050 | 0.0015 | 0.002 | — | — | — | — | — | — | 1.6 |
| 2 | — | 0.0048 | 0.0015 | 0.002 | — | — | — | — | — | — | 1.6 |

TABLE 1-continued

| | | | | | | | | | | | |
|---|---|---|---|---|---|---|---|---|---|---|---|
| 3 | — | 0.0048 | 0.0015 | 0.002 | — | — | — | — | — | — | 1.6 |
| 4 | — | 0.0050 | 0.0015 | 0.002 | — | — | — | — | — | — | 0.9 |
| 5 | — | 0.0050 | 0.0015 | 0.002 | — | — | — | — | — | — | 0.9 |
| 6 | — | 0.0050 | 0.0015 | 0.002 | — | — | — | — | — | — | 0.9 |
| 7 | — | 0.0050 | 0.0015 | 0.002 | — | — | — | — | — | — | 0.9 |
| 8 | — | 0.0050 | 0.0015 | 0.002 | — | — | — | — | — | — | 0.9 |
| 9 | — | 0.0050 | 0.0015 | 0.002 | — | — | — | — | — | — | 0.9 |
| 10 | — | 0.0050 | 0.0015 | 0.002 | — | — | — | — | — | — | 0.9 |
| 11 | — | 0.0040 | — | 0.002 | — | — | — | — | — | — | 0.9 |
| 12 | — | 0.0043 | — | 0.002 | — | — | — | — | — | — | 0.9 |
| 13 | — | 0.0040 | — | 0.002 | — | — | — | — | — | — | 0.9 |
| 14 | — | 0.0041 | — | 0.002 | — | — | — | — | — | — | 0.9 |
| 15 | — | 0.0042 | — | 0.002 | — | — | — | — | — | — | 0.9 |
| 16 | — | 0.0042 | — | 0.002 | — | — | — | — | — | — | 0.9 |
| 17 | 0.0007 | 0.0042 | — | 0.002 | — | — | — | — | — | — | 0.9 |
| 18 | — | 0.0042 | — | 0.002 | 0.0020 | — | — | — | — | — | 0.9 |
| 19 | — | 0.0042 | — | 0.002 | — | 0.002 | — | — | — | — | 0.9 |
| 20 | — | 0.0042 | — | 0.002 | — | — | 0.01 | — | — | — | 0.9 |
| 21 | — | 0.0042 | — | 0.002 | — | — | — | 0.5 | — | — | 0.9 |
| 22 | — | 0.0042 | — | 0.002 | — | — | — | — | 0.5 | — | 0.9 |
| 23 | — | 0.0042 | — | 0.002 | — | — | — | — | — | 0.0010 | 0.9 |
| 24 | — | 0.0050 | 0.0015 | 0.002 | — | — | — | — | — | — | 0.9 |

*The remainder including iron and inevitable impurities other than P and S

TABLE 2

| Test | Chemical composition* (in mass percent) | | | | | | | | | | | |
|---|---|---|---|---|---|---|---|---|---|---|---|---|
| Number | C | Si | Mn | P | S | Al | Cu | Ni | Cr | Mo | V | Nb |
| 25 | 0.021 | 0.25 | 1.50 | 0.010 | 0.002 | 0.030 | — | — | 0.25 | 0.25 | 0.045 | — |
| 26 | 0.151 | 0.25 | 1.50 | 0.010 | 0.002 | 0.030 | — | — | 0.25 | 0.25 | 0.030 | — |
| 27 | 0.120 | 0.60 | 1.50 | 0.010 | 0.002 | 0.030 | — | — | 0.25 | 0.25 | 0.030 | — |
| 28 | 0.120 | 0.25 | 0.78 | 0.010 | 0.002 | 0.030 | — | — | 0.25 | 0.25 | 0.030 | — |
| 29 | 0.120 | 0.25 | 2.25 | 0.010 | 0.002 | 0.030 | — | — | 0.25 | 0.25 | 0.030 | — |
| 30 | 0.120 | 0.25 | 1.50 | 0.020 | 0.002 | 0.030 | — | — | 0.25 | 0.25 | 0.030 | — |
| 31 | 0.120 | 0.25 | 1.50 | 0.010 | 0.020 | 0.030 | — | — | 0.25 | 0.25 | 0.030 | — |
| 32 | 0.120 | 0.25 | 1.50 | 0.010 | 0.002 | 0.004 | — | — | 0.25 | 0.25 | 0.030 | — |
| 33 | 0.120 | 0.25 | 1.50 | 0.010 | 0.002 | 0.070 | — | — | 0.25 | 0.25 | 0.030 | — |
| 34 | 0.100 | 0.25 | 1.50 | 0.010 | 0.002 | 0.030 | 2.20 | — | 0.25 | 0.25 | 0.030 | — |
| 35 | 0.100 | 0.25 | 1.50 | 0.010 | 0.002 | 0.030 | — | 2.23 | 0.25 | 0.25 | 0.030 | — |
| 36 | 0.110 | 0.25 | 1.50 | 0.010 | 0.002 | 0.030 | — | — | 0.05 | 0.25 | 0.030 | — |
| 37 | 0.120 | 0.25 | 1.50 | 0.010 | 0.002 | 0.030 | — | — | 2.10 | 0.25 | 0.030 | — |
| 38 | 0.120 | 0.25 | 1.50 | 0.010 | 0.002 | 0.030 | — | — | 0.25 | 0.04 | 0.030 | — |
| 39 | 0.120 | 0.25 | 1.50 | 0.010 | 0.002 | 0.030 | — | — | 0.25 | 0.60 | 0.030 | — |
| 40 | 0.120 | 0.25 | 1.50 | 0.010 | 0.002 | 0.030 | — | — | 0.25 | 0.25 | 0.11 | — |
| 41 | 0.120 | 0.25 | 1.50 | 0.010 | 0.002 | 0.030 | — | — | 0.25 | 0.25 | 0.030 | 0.065 |
| 42 | 0.120 | 0.25 | 1.50 | 0.010 | 0.002 | 0.030 | — | — | 0.25 | 0.25 | 0.030 | — |
| 43 | 0.120 | 0.25 | 1.00 | 0.010 | 0.002 | 0.030 | — | — | 0.10 | 0.05 | 0.030 | — |
| 44 | 0.120 | 0.25 | 1.50 | 0.010 | 0.002 | 0.030 | — | — | 0.25 | 0.25 | 0.030 | — |
| 45 | 0.120 | 0.25 | 1.50 | 0.010 | 0.002 | 0.030 | — | — | 0.25 | 0.25 | 0.030 | — |
| 46 | 0.120 | 0.25 | 1.50 | 0.010 | 0.002 | 0.030 | — | — | 0.24 | 0.25 | 0.030 | — |
| 47 | 0.120 | 0.25 | 1.50 | 0.010 | 0.002 | 0.030 | — | — | 0.25 | 0.25 | 0.030 | — |
| 48 | 0.120 | 0.25 | 1.50 | 0.010 | 0.002 | 0.030 | — | — | 0.25 | 0.25 | 0.030 | — |
| 49 | 0.120 | 0.25 | 1.50 | 0.010 | 0.002 | 0.030 | — | — | 0.25 | 0.25 | 0.030 | — |
| 50 | 0.120 | 0.25 | 1.50 | 0.010 | 0.002 | 0.030 | — | — | 0.25 | 0.25 | 0.030 | — |
| 51 | 0.120 | 0.25 | 1.50 | 0.010 | 0.002 | 0.030 | — | — | 0.25 | 0.25 | 0.030 | — |
| 52 | 0.120 | 0.25 | 1.50 | 0.010 | 0.002 | 0.030 | — | — | 0.25 | 0.25 | 0.030 | — |
| 53 | 0.120 | 0.25 | 1.50 | 0.010 | 0.002 | 0.030 | — | — | 0.25 | 0.25 | 0.030 | — |
| 54 | 0.120 | 0.25 | 1.50 | 0.010 | 0.002 | 0.030 | — | — | 0.25 | 0.25 | 0.030 | — |
| 55 | 0.120 | 0.25 | 1.50 | 0.010 | 0.002 | 0.030 | — | — | 0.25 | 0.25 | 0.030 | — |

| Test | Chemical composition* (in mass percent) | | | | | | | | | | | Value A |
|---|---|---|---|---|---|---|---|---|---|---|---|---|
| Number | Ti | B | N | Ca | O | Mg | Zr | Hf | W | Co | REM | (%) |
| 25 | — | — | 0.0042 | — | 0.002 | — | — | — | — | — | — | 1.4 |
| 26 | — | — | 0.0042 | — | 0.002 | — | — | — | — | — | — | 1.7 |
| 27 | — | — | 0.0042 | — | 0.002 | — | — | — | — | — | — | 2.8 |
| 28 | — | — | 0.0042 | — | 0.002 | — | — | — | — | — | — | 1.6 |
| 29 | — | — | 0.0042 | — | 0.002 | — | — | — | — | — | — | 1.6 |
| 30 | — | — | 0.0042 | — | 0.002 | — | — | — | — | — | — | 1.6 |
| 31 | — | — | 0.0042 | — | 0.002 | — | — | — | — | — | — | 1.6 |
| 32 | — | — | 0.0042 | — | 0.002 | — | — | — | — | — | — | 1.5 |
| 33 | — | — | 0.0042 | — | 0.002 | — | — | — | — | — | — | 1.9 |
| 34 | — | — | 0.0042 | — | 0.002 | — | — | — | — | — | — | 1.6 |
| 35 | — | — | 0.0042 | — | 0.002 | — | — | — | — | — | — | 1.6 |

TABLE 2-continued

| | | | | | | | | | | | | |
|---|---|---|---|---|---|---|---|---|---|---|---|---|
| 36 | — | — | 0.0042 | — | 0.002 | — | — | — | — | — | — | 1.6 |
| 37 | — | — | 0.0042 | — | 0.002 | — | — | — | — | — | — | 1.6 |
| 38 | — | — | 0.0042 | — | 0.002 | — | — | — | — | — | — | 1.6 |
| 39 | — | — | 0.0042 | — | 0.002 | — | — | — | — | — | — | 1.6 |
| 40 | — | — | 0.0042 | — | 0.002 | — | — | — | — | — | — | 1.6 |
| 41 | — | — | 0.0042 | — | 0.002 | — | — | — | — | — | — | 1.6 |
| 42 | 0.033 | — | 0.0042 | — | 0.002 | — | — | — | — | — | — | 1.6 |
| 43 | — | 0.0051 | 0.0042 | — | 0.002 | — | — | — | — | — | — | 1.6 |
| 44 | — | — | 0.0018 | — | 0.002 | — | — | — | — | — | — | 1.6 |
| 45 | — | — | 0.0125 | — | 0.002 | — | — | — | — | — | — | 1.6 |
| 46 | — | — | 0.0042 | — | 0.011 | — | — | — | — | — | — | 1.6 |
| 47 | — | — | 0.0042 | — | 0.002 | — | — | — | — | — | — | 1.6 |
| 48 | — | — | 0.0042 | — | 0.002 | — | — | — | — | — | — | 1.6 |
| 49 | — | — | 0.0042 | — | 0.002 | — | — | — | — | — | — | 1.6 |
| 50 | — | — | 0.0042 | — | 0.002 | — | — | — | — | — | — | 1.6 |
| 51 | — | — | 0.0042 | — | 0.002 | — | — | — | — | — | — | 1.6 |
| 52 | — | — | 0.0042 | — | 0.002 | — | — | — | — | — | — | 1.6 |
| 53 | — | — | 0.0042 | — | 0.002 | — | — | — | — | — | — | 1.6 |
| 54 | — | — | 0.0042 | — | 0.002 | — | — | — | — | — | — | 1.6 |
| 55 | — | — | 0.0042 | — | 0.002 | — | — | — | — | — | — | 1.6 |

*The remainder including iron and inevitable impurities other than P and S

TABLE 3

| | Manufacturing conditions | | | | | | | | |
|---|---|---|---|---|---|---|---|---|---|
| | Heating | Rolling | Rolling | Temperature | Cooling | Reheating | Cooling | Tempering | |
| Test Number | temperature (° C.) | reduction (%) at 950° C.-850° C. | reduction (%) in final pass | (° C.) in final pass | rate (° C./sec) after rolling | temperature (° C.) | rate (° C./sec) upon quenching | Number of times | Temperature (° C.) |
| 1 | 1150 | 15 | 3 | 800 | 0.3 | 930 | 2.0 | 2 | 650 |
| 2 | 1150 | 20 | 10 | 800 | 0.3 | 930 | 2.0 | 2 | 700 |
| 3 | 1150 | 20 | 3 | 800 | 0.3 | 930 | 2.0 | 2 | 550 |
| 4 | 1150 | 15 | 3 | 800 | 0.3 | 930 | 2.0 | 2 | 650 |
| 5 | 1150 | 15 | 3 | 850 | 0.3 | 930 | 2.0 | 2 | 600 |
| 6 | 1150 | 15 | 3 | 850 | 0.3 | 930 | 2.0 | 2 | 600 |
| 7 | 1150 | 10 | 4 | 850 | 0.3 | 930 | 2.0 | 2 | 700 |
| 8 | 1150 | 15 | 4 | 850 | 0.3 | 930 | 2.0 | 2 | 650 |
| 9 | 1150 | 15 | 4 | 800 | 0.3 | 930 | 2.0 | 2 | 600 |
| 10 | 1150 | 15 | 4 | 800 | 0.3 | 930 | 2.0 | 2 | 650 |
| 11 | 1150 | 15 | 5 | 800 | 0.3 | 930 | 2.0 | 2 | 600 |
| 12 | 1150 | 10 | 5 | 800 | 0.3 | 930 | 2.0 | 2 | 650 |
| 13 | 1150 | 15 | 5 | 850 | 0.3 | 930 | 2.0 | 2 | 650 |
| 14 | 1150 | 10 | 6 | 850 | 0.3 | 930 | 2.0 | 2 | 650 |
| 15 | 1150 | 15 | 6 | 850 | 0.3 | 930 | 2.0 | 2 | 650 |
| 16 | 1150 | 15 | 6 | 850 | 0.3 | 930 | 2.0 | 2 | 650 |
| 17 | 1000 | 15 | 6 | 800 | 0.3 | 930 | 2.0 | 2 | 650 |
| 18 | 1150 | 15 | 7 | 800 | 0.3 | 930 | 2.0 | 2 | 650 |
| 19 | 1150 | 10 | 7 | 800 | 0.3 | 930 | 2.0 | 2 | 650 |
| 20 | 1150 | 15 | 8 | 800 | 0.3 | 930 | 2.0 | 2 | 650 |
| 21 | 1150 | 15 | 8 | 820 | 0.3 | 930 | 2.0 | 2 | 650 |
| 22 | 1150 | 15 | 10 | 830 | 0.3 | 930 | 2.0 | 2 | 700 |
| 23 | 1150 | 10 | 3 | 840 | 0.3 | 930 | 2.0 | 2 | 550 |
| 24 | 1150 | 15 | 5 | 830 | 0.3 | 930 | 2.0 | 2 | 600 |

TABLE 4

| | Manufacturing conditions | | | | | | | | |
|---|---|---|---|---|---|---|---|---|---|
| | Heating | Rolling | Rolling | Temperature | Cooling | Reheating | Cooling rate | Tempering | |
| Test Number | temperature (° C.) | reduction (%) at 950° C.-850° C. | reduction (%) in final pass | (° C.) in final pass | rate (° C./sec) after rolling | temperature (° C.) | (° C./sec) upon quenching | Number of times | Temperature (° C.) |
| 25 | 1000 | 10 | 3 | 850 | 0.3 | 930 | 2.0 | 2 | 650 |
| 26 | 1000 | 10 | 3 | 850 | 0.3 | 930 | 2.0 | 2 | 650 |
| 27 | 1000 | 10 | 3 | 850 | 0.3 | 930 | 2.0 | 2 | 650 |
| 28 | 1000 | 10 | 3 | 850 | 0.3 | 930 | 2.0 | 2 | 650 |
| 29 | 1000 | 10 | 3 | 850 | 0.3 | 930 | 2.0 | 2 | 650 |
| 30 | 1000 | 10 | 3 | 850 | 0.3 | 930 | 2.0 | 2 | 650 |
| 31 | 1000 | 10 | 3 | 850 | 0.3 | 930 | 2.0 | 2 | 650 |

TABLE 4-continued

| Test Number | Manufacturing conditions: Heating temperature (° C.) | Rolling reduction (%) at 950° C.-850° C. | Rolling reduction (%) in final pass | Temperature (° C.) in final pass | Cooling rate (° C./sec) after rolling | Reheating temperature (° C.) | Cooling rate (° C./sec) upon quenching | Tempering: Number of times | Tempering: Temperature (° C.) |
|---|---|---|---|---|---|---|---|---|---|
| 32 | 1000 | 10 | 3 | 850 | 0.3 | 930 | 2.0 | 2 | 650 |
| 33 | 1000 | 10 | 3 | 850 | 0.3 | 930 | 2.0 | 2 | 650 |
| 34 | 1000 | 10 | 3 | 850 | 0.3 | 930 | 2.0 | 2 | 650 |
| 35 | 1000 | 10 | 3 | 850 | 0.3 | 930 | 2.0 | 2 | 650 |
| 36 | 1000 | 10 | 3 | 850 | 0.3 | 930 | 2.0 | 2 | 650 |
| 37 | 1000 | 10 | 3 | 850 | 0.3 | 930 | 2.0 | 2 | 650 |
| 38 | 1000 | 10 | 3 | 850 | 0.3 | 930 | 2.0 | 2 | 650 |
| 39 | 1000 | 10 | 3 | 850 | 0.3 | 930 | 2.0 | 2 | 650 |
| 40 | 1000 | 10 | 3 | 850 | 0.3 | 930 | 2.0 | 2 | 650 |
| 41 | 1000 | 10 | 3 | 850 | 0.3 | 930 | 2.0 | 2 | 650 |
| 42 | 1000 | 10 | 3 | 850 | 0.3 | 930 | 2.0 | 2 | 650 |
| 43 | 1000 | 10 | 3 | 850 | 0.3 | 930 | 2.0 | 2 | 650 |
| 44 | 1000 | 10 | 3 | 850 | 0.3 | 930 | 2.0 | 2 | 650 |
| 45 | 1000 | 10 | 3 | 850 | 0.3 | 930 | 2.0 | 2 | 650 |
| 46 | 1000 | 10 | 3 | 850 | 0.3 | 930 | 2.0 | 2 | 650 |
| 47 | 1000 | 5 | 3 | 850 | 0.3 | 930 | 2.0 | 2 | 650 |
| 48 | 1000 | 10 | 2 | 850 | 0.3 | 930 | 2.0 | 2 | 650 |
| 49 | 1000 | 10 | 1 | 850 | 0.3 | 930 | 2.0 | 2 | 650 |
| 50 | 1000 | 10 | 3 | 880 | 0.3 | 930 | 2.0 | 2 | 650 |
| 51 | 1000 | 10 | 3 | 850 | 0.3 | 930 | 0.1 | 2 | 650 |
| 52 | 1000 | 10 | 3 | 850 | 0.3 | 930 | 30.0 | 2 | 650 |
| 53 | 1000 | 10 | 3 | 850 | 0.3 | 930 | 2.0 | 1 | 650 |
| 54 | 1000 | 10 | 3 | 850 | 0.3 | 930 | 2.0 | 2 | 710 |
| 55 | 1000 | 10 | 3 | 850 | 0.3 | 930 | 2.0 | 2 | 540 |

The above-prepared steel plates were examined to measure or determine structures [area fraction of bainite, lath width of bainite, sizes (average equivalent circle diameter and maximum equivalent circle diameter) of martensite-austenite constituents], mechanical properties (yield strength YS, tensile strength TS, and drop weight properties in terms of NDT, of the steel plates) according to the following methods.

[Measurement of Area Fraction of Bainite]

Each of the prepared steel plates was observed and photographed at a position of depth of one-fourth the thickness under an optical microscope, a region in the photograph other than bainite was colored, the colored region was transferred to a transparent film, and the resulting film was image-analyzed with an image analyzer (Image-Pro Plus supplied by Media Cybernetics, Inc.) to determine an area percentage of the colored region. The area percentage of the colored region was subtracted from the total, 100%, to give an area fraction of bainite. The observation with the optical microscope was performed at a 100-fold magnification, by which photographs were taken in three fields of view per sample, and an average of the area fractions of bainite in the three fields of view (three photographs) was calculated.

[Measurement of Width of Bainite Laths]

A sample was taken from each of the prepared steel plates at a position of depth of one-fourth the thickness, observed under a scanning electron microscope (SEM) at a 1000-fold magnification, widths of bainite laths were measured in three fields of view, averaged, and this was defined as a lath width (lath width of bainite) of the sample steel plate.

[Evaluation of Tensile Properties of Steel Plate]

Specimens in accordance with Nippon Kaiji Kyokai Standard (NK) U14 were samples from each of the steel plates at a position of depth of one-fourth the thickness in the width direction and subjected to tensile tests according to Japanese Industrial Standard (JIS) Z2241 to measure yield stress YS (as upper yield point YP or 0.2%-yield strength (proof stress) $\sigma_{02}$) and tensile strength TS. A sample having a yield strength YS of 415 MPa or more and a tensile strength TS of 620 MPa or more, each on average of three measurements, was accepted herein.

[Measurement of Size (Equivalent Circle Diameter) of Martensite-Austenite Constituents (MA)]

Specimen were sampled from the respective steel plates at a position of depth of one-fourth the thickness, subjected to LePera etching, observed on structure under an optical microscope at a 1000-fold magnification in five fields of view, in which a white region was determined as a martensite-austenite constituent. Sizes (average equivalent circle diameter and maximum equivalent circle diameter) of determined martensite-austenite constituents were measured by image analysis with the image analyzer (Image-Pro Plus supplied by Media Cybernetics, Inc.).

[Evaluation of Drop Weight Properties]

Drop weight tests were performed on the respective steel plates in accordance with American Society for Testing and Materials' Standard (ASTM) E208 (2006) to measure a nil-ductility transition temperature NDT. Specimens used herein were P-3 type specimens and were sampled from the steel plates at a position of depth of one-fourth the thickness along the C-direction (direction perpendicular to the rolling direction). Straight beads were formed on the surface of specimen using a welding nod ("NRL-S" supplied by Kabushiki Kaisha Kobe Seiko Sho (Kobe Steel), having a diameter of 5 mm). Dimensions of the specimens used herein are illustrated in FIG. 1 (average view) (L: 50 mm, W: 130 mm). A sample having an NDT of −70° C. or lower was accepted herein.

The results of these measurements are indicated in following Tables 5 and 6 (Test Nos. 1 to 55). The symbol "-" in structure in Table 6 (Test Nos. 51 and 52) indicates that the samples contained no bainitic structure. Specifically, Test No. 51 contained a ferritic-pearlitic structure, and Test No. 52 contained a martensitic structure.

TABLE 5

| Test | Structure | | | | Mechanical properties | | |
|---|---|---|---|---|---|---|---|
| | Bainite | | MA size (equivalent circle diameter) | | Yield strength | Tensile strength | Drop weight |
| Number | Area fraction (%) | Lath width (μm) | Average (μm) | Maximum (μm) | YS (MPa) | TS (MPa) | properties NDT (° C.) |
| 1 | 96 | 2.6 | 1.1 | 2.0 | 547 | 641 | −70 |
| 2 | 97 | 0.7 | 1.5 | 2.5 | 548 | 658 | −90 |
| 3 | 97 | 2.1 | 1.5 | 3.0 | 548 | 658 | −75 |
| 4 | 95 | 2.7 | 0.6 | 0.8 | 536 | 621 | −88 |
| 5 | 95 | 2.6 | 0.5 | 0.9 | 548 | 626 | −85 |
| 6 | 96 | 2.6 | 0.5 | 0.9 | 560 | 636 | −82 |
| 7 | 96 | 2.9 | 0.5 | 0.7 | 572 | 646 | −77 |
| 8 | 96 | 2.4 | 0.5 | 0.8 | 572 | 646 | −82 |
| 9 | 97 | 2.4 | 0.5 | 0.9 | 584 | 656 | −79 |
| 10 | 97 | 2.4 | 0.5 | 0.8 | 584 | 656 | −80 |
| 11 | 94 | 2.3 | 0.5 | 0.9 | 526 | 624 | −79 |
| 12 | 95 | 2.7 | 0.8 | 1.3 | 549 | 629 | −85 |
| 13 | 94 | 2.3 | 0.6 | 1.0 | 527 | 628 | −82 |
| 14 | 97 | 2.5 | 0.3 | 0.3 | 573 | 651 | −96 |
| 15 | 100 | 1.9 | 0.7 | 1.0 | 654 | 715 | −92 |
| 16 | 97 | 2.0 | 0.7 | 1.0 | 584 | 654 | −82 |
| 17 | 97 | 2.0 | 0.9 | 1.5 | 592 | 651 | −85 |
| 18 | 95 | 1.9 | 0.7 | 1.1 | 548 | 624 | −92 |
| 19 | 95 | 2.4 | 0.7 | 1.1 | 548 | 624 | −87 |
| 20 | 95 | 1.7 | 0.7 | 1.0 | 548 | 624 | −94 |
| 21 | 95 | 1.7 | 0.7 | 1.0 | 548 | 624 | −94 |
| 22 | 95 | 1.4 | 0.7 | 0.9 | 548 | 624 | −97 |
| 23 | 95 | 3.2 | 0.7 | 1.3 | 548 | 624 | −78 |
| 24 | 95 | 2.3 | 0.5 | 0.8 | 544 | 625 | −86 |

TABLE 6

| Test | Structure | | | | Mechanical properties | | |
|---|---|---|---|---|---|---|---|
| | Bainite | | MA size (equivalent circle diameter) | | Yield strength | Tensile strength | Drop weight |
| Number | Area fraction (%) | Lath width (μm) | Average (μm) | Maximum (μm) | YS (MPa) | TS (MPa) | properties NDT (° C.) |
| 25 | 94 | 3.2 | 1.2 | 2.2 | 527 | 591 | −86 |
| 26 | 97 | 3.1 | 1.5 | 2.8 | 558 | 670 | −25 |
| 27 | 98 | 3.0 | 2.6 | 5.0 | 580 | 689 | 0 |
| 28 | 93 | 3.2 | 1.9 | 3.5 | 479 | 583 | −63 |
| 29 | 99 | 3.0 | 2.1 | 3.9 | 607 | 707 | −25 |
| 30 | 96 | 3.1 | 1.5 | 2.7 | 542 | 644 | −25 |
| 31 | 96 | 3.1 | 1.5 | 2.7 | 542 | 644 | −25 |
| 32 | 100 | 3.0 | 1.3 | 2.4 | 382 | 527 | −75 |
| 33 | 90 | 3.3 | 1.7 | 3.2 | 646 | 719 | −20 |
| 34 | 95 | 3.1 | 2.0 | 3.7 | 512 | 629 | −15 |
| 35 | 97 | 3.1 | 2.5 | 4.8 | 545 | 669 | −15 |
| 36 | 95 | 3.2 | 1.8 | 3.3 | 516 | 614 | −59 |
| 37 | 100 | 2.7 | 1.5 | 2.7 | 733 | 840 | −5 |
| 38 | 91 | 3.3 | 1.5 | 2.8 | 431 | 549 | −63 |
| 39 | 100 | 2.8 | 1.4 | 2.5 | 728 | 802 | −25 |
| 40 | 94 | 2.8 | 1.4 | 2.5 | 735 | 804 | −30 |
| 41 | 95 | 3.1 | 1.2 | 2.1 | 545 | 629 | −25 |
| 42 | 91 | 3.3 | 1.4 | 2.6 | 417 | 545 | −30 |
| 43 | 100 | 2.0 | 1.6 | 2.8 | 930 | 1186 | −25 |
| 44 | 96 | 3.1 | 1.4 | 2.6 | 542 | 645 | −20 |
| 45 | 98 | 4.0 | 1.6 | 2.9 | 551 | 674 | −20 |
| 46 | 64 | 6.0 | 1.5 | 1.1 | 541 | 643 | −35 |
| 47 | 96 | 4.0 | 1.5 | 2.7 | 542 | 644 | −35 |
| 48 | 96 | 4.0 | 1.5 | 3.1 | 542 | 644 | −40 |
| 49 | 96 | 4.0 | 1.5 | 3.2 | 542 | 644 | −25 |
| 50 | 96 | 5.0 | 1.5 | 3.2 | 542 | 644 | −30 |
| 51 | — | — | — | — | 310 | 453 | −61 |
| 52 | — | — | — | — | 920 | 1389 | −25 |
| 53 | 96 | 3.1 | 1.5 | 3.2 | 542 | 644 | −10 |
| 54 | 96 | 4.0 | 1.5 | 2.6 | 542 | 644 | −35 |
| 55 | 96 | 3.1 | 1.5 | 4.0 | 542 | 644 | −15 |

The results indicate as follows. Numbers (Nos.) mentioned below represent Test Numbers (Test Nos.) indicated in Tables 1 to 6. Nos. 1 to 24 were samples satisfying conditions specified in the present invention and having chemical compositions and structures suitably controlled. These samples exhibited high strengths and good drop weight properties.

In contrast, Nos. 25 to 55 were samples not satisfying at least one of the conditions specified in the present invention and were poor in at least one of the evaluated properties. Among them, No. 25 was a sample having a carbon content of less than the range specified in the present invention and exhibited insufficient strengths, although having good drop weight properties. No. 26 was a sample having a carbon content of more than the range specified in the present invention and had insufficient drop weight properties, although having high strengths.

No. 27 was a sample having a Si content of more than the range specified in the present invention and a value A of higher than the range specified in the present invention, thereby had a large size (maximum equivalent circle diameter) of martensite-austenite constituents, and had poor drop weight properties. No. 28 was a sample having an Mn content of less than the range specified in the present invention, failed to have strengths at necessary level, and had somewhat poor drop weight properties. No. 29 was a sample having an Mn content of more than the range specified in the present invention and had poor drop weight properties.

No. 30 was a sample having a phosphorus content of more than the range specified in the present invention and had poor drop weight properties, although having high strengths. No. 31 was a sample having a sulfur content of more than the range specified in the present invention and had poor drop weight properties, although having high strengths.

No. 32 was a sample having an Al content of less than the range specified in the present invention and had insufficient strengths. No. 33 was a sample having an Al content of more than the range specified in the present invention, had a large size (maximum equivalent circle diameter) of martensite-austenite constituents, and had poor drop weight properties.

No. 34 was a sample having a content of Cu, an optional composition, of more than the preferred range, had a large maximum size of martensite-austenite constituents, and had poor drop weight properties. No. 35 was a sample having a content of Ni, an optional composition, of more than the preferred range, had a large size (maximum equivalent circle diameter) of martensite-austenite constituents, and had poor drop weight properties.

No. 36 was a sample having a Cr content of less than the range specified in the present invention, had low strengths, and had somewhat poor drop weight properties. No. 37 was a sample having Cr content of more than the range specified in the present invention and had poor drop weight properties, although having high strengths.

No. 38 was a sample having an Mo content of less than the range specified in the present invention, had low strengths, and had somewhat poor drop weight properties. No. 39 was a sample having an Mo content of more than the range specified in the present invention and had poor drop weight properties, although having high strengths.

No. 40 was a sample having a vanadium content of more than the range specified in the present invention and had poor drop weight properties, although having high strengths. No. 41 was a sample having a content of Nb, an optional composition, of more than the preferred range and had poor drop weight properties.

No. 42 was a sample having a content of Ti, an optional composition, of more than the preferred range, had low strengths, and had poor drop weight properties. No. 43 was a sample having a content of boron, an optional composition, of more than the preferred range and had poor drop weight properties.

No. 44 was a sample having a nitrogen content of less than the range specified in the present invention and had poor drop weight properties. No. 45 was a sample having a nitrogen content of more than the range specified in the present invention and had poor drop weight properties. No. 46 was a sample having an oxygen content of more than the range specified in the present invention and had poor drop weight properties.

No. 47 was a sample having undergone rolling to a rolling reduction of 5% at temperatures of 950° C. to 850° C., had a large (average) lath width of bainite, and had poor drop weight properties. Nos. 48 and 49 were samples having undergone rolling in the final pass to an excessively low rolling reduction, each had a large lath width of bainite, had a size (maximum equivalent circle diameter) of martensite-austenite constituent of more than the specified value, and had poor drop weight properties.

No. 50 was a sample having undergone rolling in the final pass at an excessively high temperature, had a large lath width of bainite, had a size (maximum equivalent circle diameter) of martensite-austenite constituents of more than the specified value, and had poor drop weight properties. Nos. 51 and 52 were samples having undergone cooling upon quenching performed at a cooling rate out of the predetermined range, failed to have a microstructure mainly containing bainite, and failed to have both high strengths and good drop weight properties compatibly.

No. 53 was a sample having undergone tempering only once, had a size (maximum equivalent circle diameter) of martensite-austenite constituents of more than the specified value, and had poor drop weight properties. Nos. 54 and 55 were samples having undergone tempering at temperatures out of the suitable range, had either one of a lath width of bainite and a size (maximum equivalent circle diameter) of martensite-austenite constituents of more than the specified value, and had poor drop weight properties.

Experimental Example 2

Steels having chemical compositions given in following Table 7 were prepared as molten steels according to a common ingot making process (melting process), the molten steels were cooled into slabs (thickness: 300 mm), sequentially subjected to hot rolling, cooling, and tempering under conditions given in following Table 8, and yielded steel plates (thickness: 100 mm). Data of Test No. 24 in Tables 1, 3, and 5 are also indicated in Tables 7 and 8, for purpose of reference.

TABLE 7

| Test | Chemical composition* (in mass percent) | | | | | | | | | | | | | | | | | Value X |
|---|---|---|---|---|---|---|---|---|---|---|---|---|---|---|---|---|---|---|
| Number | C | Si | Mn | P | S | Al | Cu | Ni | Cr | Mo | V | Nb | Ti | B | N | Ca | O | (%) |
| 24 | 0.073 | 0.05 | 1.50 | 0.010 | 0.002 | 0.035 | — | — | 0.25 | 0.35 | 0.050 | — | 0.012 | — | 0.0050 | 0.0015 | 0.002 | 38 |
| 56 | 0.080 | 0.05 | 1.50 | 0.010 | 0.002 | 0.030 | — | — | 0.25 | 0.25 | 0.040 | — | 0.015 | — | 0.0050 | 0.0015 | 0.002 | 45 |
| 57 | 0.085 | 0.05 | 1.50 | 0.010 | 0.002 | 0.030 | — | — | 0.25 | 0.25 | 0.040 | — | 0.025 | — | 0.0050 | 0.0015 | 0.002 | 47 |

TABLE 7-continued

| Test | Chemical composition* (in mass percent) | | | | | | | | | | | | | | | | | Value X |
|---|---|---|---|---|---|---|---|---|---|---|---|---|---|---|---|---|---|---|
| Number | C | Si | Mn | P | S | Al | Cu | Ni | Cr | Mo | V | Nb | Ti | B | N | Ca | O | (%) |
| 58 | 0.075 | 0.05 | 1.50 | 0.010 | 0.002 | 0.030 | — | — | 0.25 | 0.25 | 0.040 | — | 0.025 | — | 0.0070 | 0.0015 | 0.002 | 42 |
| 59 | 0.080 | 0.05 | 1.50 | 0.010 | 0.002 | 0.030 | 0.20 | 0.25 | 0.25 | 0.25 | 0.040 | — | 0.015 | — | 0.0050 | 0.0015 | 0.002 | 52 |
| 60 | 0.080 | 0.05 | 1.50 | 0.010 | 0.002 | 0.030 | — | — | 0.25 | 0.22 | 0.040 | — | 0.015 | — | 0.0050 | 0.0015 | 0.002 | 45 |
| 61 | 0.080 | 0.05 | 1.50 | 0.010 | 0.002 | 0.030 | — | — | 0.22 | 0.25 | 0.040 | — | 0.015 | — | 0.0050 | 0.0015 | 0.002 | 45 |

*The remainder including iron and inevitable impurities other than P and S

TABLE 8

| | Manufacturing conditions | | | | | | | | |
|---|---|---|---|---|---|---|---|---|---|
| | Heating | Rolling | Rolling | Temperature | Cooling | Reheating | Cooling | Tempering | |
| Test Number | temperature (° C.) | reduction (%) at 950° C.-850° C. | reduction (%) in final pass | (° C.) in final pass | rate (° C./sec) after rolling | temperature (° C.) | rate (° C./sec) upon quenching | Number of times | Temperature (° C.) |
| 24 | 1150 | 15 | 5 | 830 | 0.3 | 930 | 2.0 | 2 | 600 |
| 56 | 1150 | 15 | 3 | 800 | 0.3 | 930 | 2.0 | 2 | 600 |
| 57 | 1150 | 15 | 3 | 800 | 0.3 | 930 | 2.0 | 2 | 600 |
| 58 | 1150 | 15 | 3 | 800 | 0.3 | 930 | 2.0 | 2 | 600 |
| 59 | 1150 | 15 | 3 | 800 | 0.3 | 930 | 2.0 | 2 | 600 |
| 60 | 1200 | 15 | 3 | 800 | 0.3 | 930 | 2.0 | 2 | 600 |
| 61 | 1200 | 15 | 3 | 800 | 0.3 | 930 | 2.0 | 2 | 600 |

The above-prepared steel plates were each examined to measure or determine structures [area fraction of bainite, lath width of bainite, and sizes (average equivalent circle diameter and maximum equivalent circle diameter) of martensite-austenite constituents] and mechanical properties (yield strength YS, tensile strength TS, and drop weight properties NDT, of the steel plates) according to the methods as in Example 1. They were also examined to determine sizes (average size and minimum size) of titanium-containing dispersed particles and HAZ toughness according to methods mentioned below. The results of the measurements (Test Nos. 56 to 61) as well as the results of Test No. 24 are indicated in Table 9 below.

[Measurement of Sizes of Titanium-Containing Dispersed Particles]

Each of the prepared steel plates was observed at a position of depth of one-fourth the thickness under a transmission electron microscope (TEM) at a 60000-fold magnification. The observation was performed in five fields of view in an area per field of view of 2.0 by 2.0 (μm). Areas of titanium-containing dispersed particles in each field of view were measured, from which equivalent circle diameters of the respective particles were calculated. Whether or not a particle is a titanium-containing dispersed particle was determined by the presence or absence of titanium as detected with an energy-dispersive X-ray detector (EDX) attached to the TEM. Particles having a size of less than 1 nm were excluded from the measurement. The determined equivalent circle diameters of the respective particles were arithmetically averaged, and the average was defined as an average size, and a smallest value among the determined equivalent circle diameters was defined as a minimum size.

[Measurement of HAZ Toughness]

The HAZ toughness was determined in the following manner. Charpy impact test specimens (No. 4 specimens prescribed in JIS Z 2201) were sampled from the prepared steel plates at a position of depth of one-fourth the thickness and subjected to synthetic heat-affected zone heat cycle tests as Charpy V-notch tests. Heat cycle conditions for the synthetic heat-affected zone simulated a thermal hysteresis at a heat input of 100 kJ/mm. The HAZ toughness was determined by measuring an absorbed energy at −15° C. ($vE_{45}$) on three specimens and averaging the three measurements.

TABLE 9

| Test | Structure | | | | Mechanical properties | | | Size of titanium containing dispersed particles | | HAZ |
|---|---|---|---|---|---|---|---|---|---|---|
| | Bainite | | MA size (equivalent circle diameter) | | Yield strength | Tensile strength | Drop weight properties | Average | Minimum | toughness |
| Number | Area fraction (%) | Lath width (μm) | Average (μm) | Maximum (μm) | YS (MPa) | TS (MPa) | NDT (° C.) | (nm) | (nm) | $vE_{-15}$ (J) |
| 24 | 95 | 2.3 | 0.5 | 0.8 | 544 | 625 | −86 | 46 | 7 | 67 |
| 56 | 93 | 2.8 | 0.5 | 0.9 | 579 | 671 | −85 | 39 | 9 | 119 |
| 57 | 91 | 2.8 | 0.5 | 0.9 | 544 | 645 | −72 | 37 | 8 | 122 |
| 58 | 91 | 2.8 | 0.1 | 0.1 | 541 | 644 | −80 | 40 | 8 | 116 |
| 59 | 93 | 2.8 | 0.4 | 0.7 | 579 | 671 | −70 | 32 | 6 | 128 |
| 60 | 92 | 2.8 | 0.5 | 0.9 | 563 | 657 | −85 | 29 | 15 | 193 |
| 61 | 92 | 2.8 | 0.6 | 1.0 | 576 | 668 | −84 | 39 | 14 | 179 |

The results indicate as follows. Numbers (Nos.) mentioned below represent Test Numbers (Test Nos.) indicated in Table 9. The steel plates of Nos. 56 to 61 each had an average size of titanium-containing dispersed particles of 40 nm or less and exhibited better HAZ toughness than that of the steel plate of No. 24. Among them, the steel plates of Nos. 60 and 61 each had an average size of titanium-containing dispersed particles of 40 nm or less and a minimum size of the titanium-containing dispersed particles of 10 nm or more and exhibited further better HAZ toughness.

While the present invention has been described in detail with reference to the specific embodiments thereof, it is obvious to those skilled in the art that various changes and modifications can be made in the invention without departing from the spirit and scope of the invention.

The present application is based on Japanese Patent Application No. 2010-110509 filed on May 12, 2010, the entire contents of which are incorporated herein by reference.

INDUSTRIAL APPLICABILITY

The high-strength steel plates according to the present invention are useful as structural materials typically for offshore structure, ships, and bridges and as materials for pressure vessels in nuclear power plants.

The invention claimed is:

1. A high-strength steel plate, comprising iron, and by mass percent based on a total mass of the steel plate:
from 0.03% to 0.150% of carbon (C);
from 0% or more to 0.5% of silicon (Si);
from 1.0% to 2.0% of manganese (Mn);
from more than 0% to 0.015% of phosphorus (P);
from more than 0% to 0.01% of sulfur (S);
from 0.005% to 0.06% of aluminum (Al);
from 0.10% to 0.5% of chromium (Cr);
from 0.05% to 0.5% of molybdenum (Mo);
from more than 0% to 0.10% of vanadium (V);
from 0.0020% to 0.010% of nitrogen (N); and
from more than 0% to 0.010% of oxygen (O),
wherein a microstructure of the steel plate at a depth of one-fourth to one half the thickness from a surface of the steel plate has an area fraction of bainite of 90% or more, an average lath width of bainite of 3.5 μm or less, and a maximum equivalent circle diameter of martensite-austenite constituents in bainite of 3.0 μm or less.

2. The high-strength steel plate of claim 1, wherein the martensite-austenite constituents have an average equivalent circle diameter of 1.0 μm or less.

3. The high-strength steel plate of claim 1, further comprising, by mass percent based on a total mass of the steel plate:
from more than 0% to 2% of copper (Cu);
from more than 0% to 2% of nickel (Ni); or
a combination thereof.

4. The high-strength steel plate of claim 1, further comprising, by mass percent based on a total mass of the steel plate:
from more than 0% to 0.05% of niobium (Nb);
from more than 0% to 0.005% of boron (B); or
a combination thereof.

5. The high-strength steel plate of any one of claims 1 to 4, further comprising, by mass percent based on a total mass of the steel plate:
from more than 0% to 0.005% of magnesium (Mg);
from more than 0% to 0.030% of titanium (Ti); or
a combination thereof.

6. The high-strength steel plate of claim 1, further comprising, by mass percent based on a total mass of the steel plate:
from 0.005% to 0.030% of titanium (Ti), wherein titanium-comprising dispersed particles present in the steel plate have an average equivalent circle diameter of 40 nm or less.

7. The high-strength steel plate of claim 6, wherein the titanium-comprising dispersed particles have a minimum equivalent circle diameter of 10 nm or more.

8. The high-strength steel plate of claim 1, further comprising, by mass based on a total mass of the steel plate:
from more than 0% to 0.1% of zirconium (Zr);
from more than 0% to 0.05% of hafnium (Hf); or
a combination thereof.

9. The high-strength steel plate of claim 1, further comprising, by mass based on a total mass of the steel plate:
from more than 0% to 0.0035% of calcium (Ca).

10. The high-strength steel plate of claim 1, further comprising, by mass based on a total mass of the steel plate:
from more than 0% to 2.5% of cobalt (Co);
from more than 0% to 2.5% of tungsten (W); or
a combination thereof.

11. The high-strength steel plate of claim 1, further comprising, by mass based on a total mass of the steel plate:
from more than 0% to 0.01% of a rare-earth element.

12. The high-strength steel plate of claim 1, further comprising, by mass based on a total mass of the steel plate:
from 0.2% to 1% of copper (Cu);
from 0.2% to 1% of nickel (Ni); or
a combination thereof.

13. The high-strength steel plate of claim 1, further comprising, by mass based on a total mass of the steel plate:
from 0.01% to 0.04% of niobium (Nb);
from 0.0005% to 0.002% of boron (B); or
a combination thereof.

14. The high-strength steel plate of claim 1, further comprising, by mass based on a total mass of the steel plate:
from more than 0% to 0.003% of magnesium (Mg);
from more than 0% to 0.020% of titanium (Ti); or
a combination thereof.

15. The high-strength steel plate of claim 6, wherein the titanium-comprising dispersed particles have an average equivalent circle diameter of 30 nm or less.

16. The high-strength steel plate of claim 15, wherein the titanium-comprising dispersed particles have a minimum equivalent circle diameter of 15 nm or more.

17. The high-strength steel plate of claim 1, further comprising, by mass based on a total mass of the steel plate:
from more than 0% to 0.03% of zirconium (Zr);
from more than 0% to 0.01% of hafnium (Hf); or
a combination thereof.

18. The high-strength steel plate of claim 1, further comprising, by mass based on a total mass of the steel plate:
from more than 0% to 0.0020% of calcium (Ca).

19. The high-strength steel plate of claim 1, wherein the high-strength steel plate has a nil-ductility transition temperature (NDT) of −70° C. or lower when measured by ASTM E208 (2006).

20. A high-strength steel plate, comprising iron, and by mass percent based on a total mass of the steel plate:
from 0.03% to 0.150% of carbon (C);
from 0% or more to 0.5% of silicon (Si);
from 1.0% to 2.0% of manganese (Mn);
from more than 0% to 0.015% of phosphorus (P);
from more than 0% to 0.01% of sulfur (S);
from 0.005% to 0.06% of aluminum (Al);
from 0.10% to 0.5% of chromium (Cr);
from 0.05% to 0.5% of molybdenum (Mo);
from more than 0% to 0.10% of vanadium (V);

from 0.0020% to 0.010% of nitrogen (N); and from more than 0% to 0.010% of oxygen (O), wherein a microstructure of the steel plate at a depth of one-fourth to one half the thickness from a surface of the steel plate has an area fraction of bainite of 90% or more, an average lath width of bainite of 3.5 μm or less, and a maximum equivalent circle diameter of martensite-austenite constituents in bainite of 3.0 μm or less;

wherein the high-strength steel plate has a yield strength (YS) of 415 MPa or more, a tensile strength (TS) of 620 MPa or more, and a nil-ductility transition temperature (NDT) of −70° C. or lower when measured by ASTM E208 (2006).

* * * * *